US007007412B2

(12) United States Patent
Munster

(10) Patent No.: US 7,007,412 B2
(45) Date of Patent: Mar. 7, 2006

(54) SHOE OR ATHLETIC SHOE

(75) Inventor: Udo Munster, Baar (CH)

(73) Assignee: Volkl Tennis GmbH, Baar (CH)

( * ) Notice: Subject to any disclaimer, the term of this patent is extended or adjusted under 35 U.S.C. 154(b) by 173 days.

(21) Appl. No.: 10/652,550

(22) Filed: Sep. 2, 2003

(65) Prior Publication Data

US 2004/0154190 A1 Aug. 12, 2004

(30) Foreign Application Priority Data

Sep. 3, 2002 (DE) ..... 102 40 530

(51) Int. Cl.
*A43B 13/18* (2006.01)

(52) U.S. Cl. ..... 36/132; 36/28; 36/136

(58) Field of Classification Search ..... 36/136, 36/132

See application file for complete search history.

(56) References Cited

U.S. PATENT DOCUMENTS

| | | | | |
|---|---|---|---|---|
| 4,814,661 | A * | 3/1989 | Ratzlaff et al. | 310/328 |
| 5,452,269 | A * | 9/1995 | Cherdak | 368/10 |
| 5,918,502 | A * | 7/1999 | Bishop | 73/172 |
| 6,865,825 | B1 * | 3/2005 | Bailey et al. | 36/88 |
| 2004/0177531 | A1 * | 9/2004 | DiBenedetto et al. | 36/132 |

FOREIGN PATENT DOCUMENTS

| | | | |
|---|---|---|---|
| GB | 2353937 | A * | 3/2001 |

* cited by examiner

*Primary Examiner*—Ted Kavanaugh
(74) *Attorney, Agent, or Firm*—Hoffman, Wasson & Gitler P.C.

(57) ABSTRACT

The invention relates to a new design for a shoe, especially an athletic shoe, with a sole that cushions mechanical stress while running, with an area with a cushioning effect and at least one further area with an effective transfer of force.

19 Claims, 1 Drawing Sheet

SHOE OR ATHLETIC SHOE

BACKGROUND OF THE INVENTION

The invention pertains to shoes, especially athletic shoes and in particular running shoes. Athletic shoes are increasingly becoming high-tech products, since both the manufacturer and the user of these shoes have extremely high expectations regarding quality and effectiveness, not only concerning the materials used, but especially with respect to the positive effects on the running process and protection of the feet while running. The result of this is that such shoes are designed with a view toward minimizing the strain on the feet and legs.

One object of the invention is to design the soles of such shoes so as to actively cushion the strains that arise while running, such as jolts, countering them by adapted damping properties to cushion their effect.

Piezo-electric materials can convert mechanical energy into electrical energy and vice versa. Mechanical stress causes a charge transfer in these materials, which can be tapped as electrical voltage (piezo effect). On the other hand, the dimensions of these materials changes under the influence of an electrical field (inverse piezo effect). Known piezo-electric materials are, for example, piezo ceramics and piezo-electric PVDF (polyvinylidenefluoride) foils.

Electro-rheological fluids have as a base material an oil in which fine particles float dispersed. This base material determines the base viscosity. When an electric field is created, the particles form chains, the length of which is dependent on the created electric field. Therefore, the viscosity of electro-rheological fluids changes in dependence on the created electric field.

SUMMARY OF THE INVENTION

This technology described above can be used for the implementation of an active traveling mechanism, or for an active cushioning for a shoe, especially an athletic shoe. The piezo-electric component (PVDF or piezo ceramic) serves as a sensor in this process. Based on the pressure that ensues when the shoe contacts the ground, electric voltage is produced. This voltage can be sent to an electronic control circuit or directly to the electro-rheological fluids. In addition, the shoe can be equipped with an acceleration sensor, which measures the speed of the runner and sends this value as additional information to the electronic control circuitry.

The sole of a modern athletic shoe can be divided into three areas. In the first area, there are no piezo elements and no electro-rheological fluids. This area is conventionally designed in the same manner as a conventional shoe sole and provides the basic cushioning of the shoe and is the outer section of the shoe sole nearest the ground. The second area is the sensor area, in which the force is transferred as directly as possible to the piezo-electric sensors. In order to ensure an effective transfer of the force, the material of the sole in this area should be relatively hard (high shore hardness). The third area is the area of active cushioning and is provided with inserts containing electro-rheological fluids. Depending on the voltage created in the second area or depending on the control impulses of the electronic circuitry, the cushioning of this area is altered by means of the electro-rheological fluids.

In actual practice, the three areas are divided for practical purposes into several or numerous spatial areas that extend over the surface of the sole. The arrangement of the areas should be such that the second area is preferably located at the areas that touch the ground first when the shoe comes into contact with the ground. The third area should preferably be located at areas in which the maximum pressure load and/or the maximum stress integral occur during a step.

BRIEF DESCRIPTION OF THE DRAWINGS

The invention is represented schematically below in connection with the following drawing figures which illustrate a sample embodiment.

DETAILED DESCRIPTION OF THE INVENTION

Figure 1:
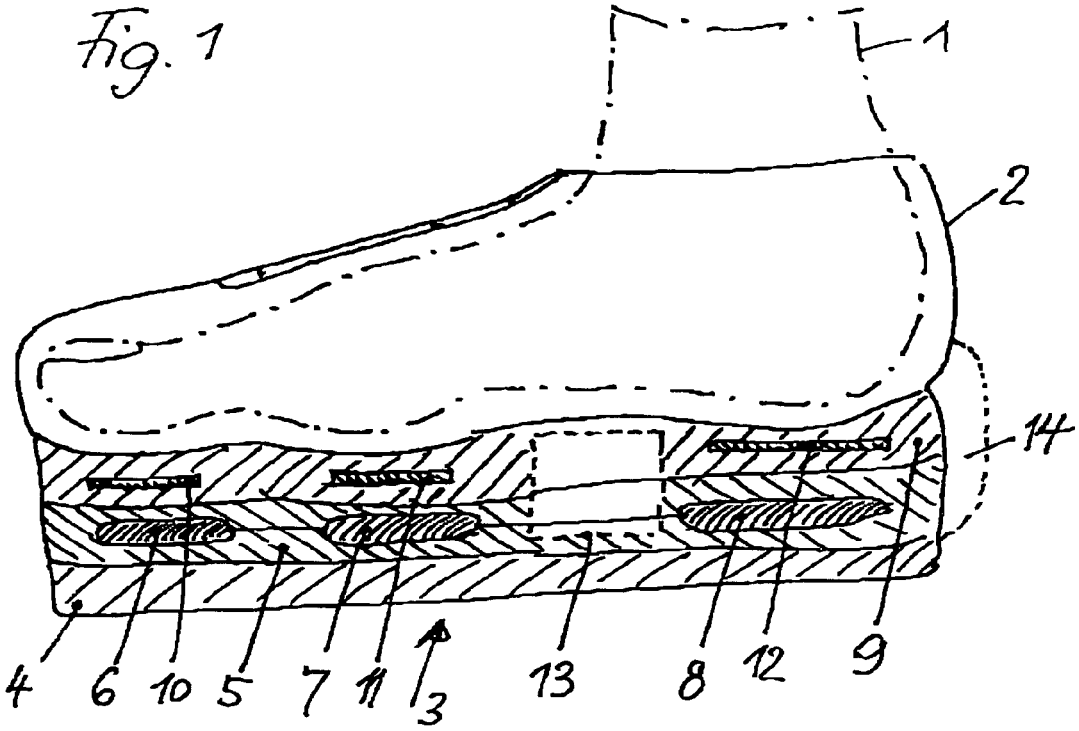
FIG. 1 shows a shoe with a cross section of a shoe sole according to the invention, with the foot indicated by a dash-dot line.

The number 1 indicates the foot, 2 refers to the shoe upper surrounding the foot, and 3 refers to the sole of the shoe. The lowest or first area of the conventional type is indicated schematically with 4, the second area 5 has piezo-electric sensors 6, 7, 8 at the preferred stress locations of the shoe sole, and the third area 9 contains the inserts 10, 11, 12 with electro-rheological fluids. Furthermore, the sole accommodates the electronic control circuitry 13, which processes the electric voltage created at the sensors or sends it directly to the electro-rheological fluids. Instead of accommodating the electronic control circuitry within the shoe sole at a suitable location 13, this electronic control circuitry can also be located on the outside of the shoe, e.g. at the heel end 14 of the shoe, or at the top of the front of the shoe or optionally at another suitable location. For example, the electronic control circuitry can be integrated in a location on the top of the shoe, e.g. where the shoe fastener is located, for example a flap that is attached to the shoe by means of a Velcro type fastener, since a display device would be easy to read at this location.

Figure 2:
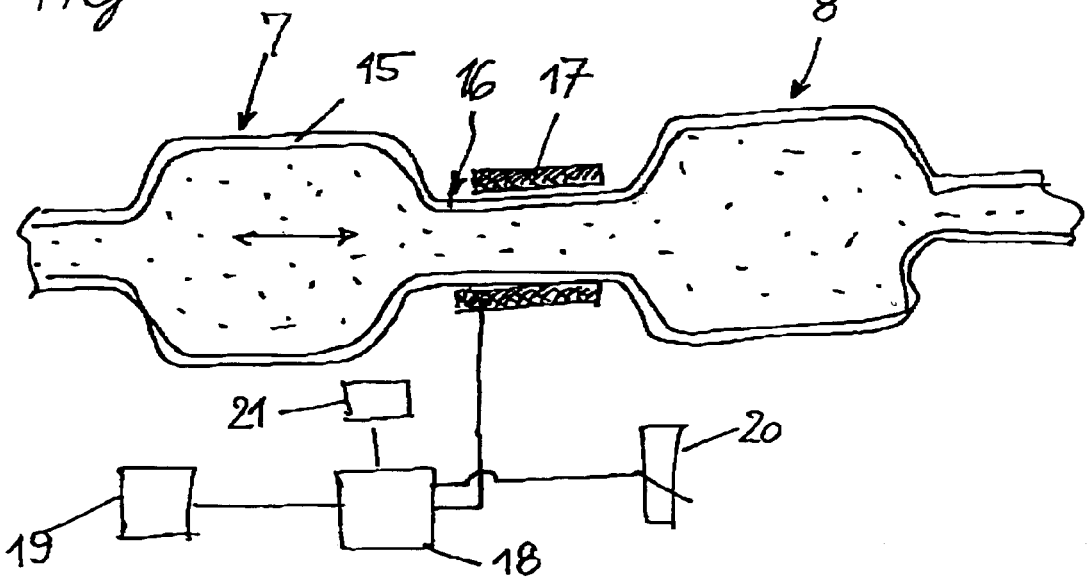
FIG. 2 shoes a schematic representation, partially in block diagram, of the principle of the cushioning system.

The schematic representation according, to FIG. 2, shows the functionality of the device according to the invention in the form of two cushioning elements 7, 8, which are depicted as cushion- or tube-like elements 15 with corresponding narrow areas 16 as connecting elements, whereby the sections 16 with a reduced profile function as nozzles. The sections 15 are designed as cushions or tube elements with an increased diameter and the sections 16 with a reduced profile alternate with each other and are filled with a fluid as a cushioning means, the viscosity of which can be altered by means of an electric and/or magnetic field. On the hose sections 16 there are electrodes 17, which upon application of an electric current produce an electric field in the respective hose section 16. The electrodes 17 on the hose sections 16 are connected with an electronic control 18, which based on a signal from one or more sensors 6, 7, 8 controls the voltage applied to the electrodes 17 and therefore the viscosity of the cushioning fluid flowing through the respective hose section 16, so that the electronic control 18 controls the regulation of the sections 16 based on the signal of the sensor (or sensors) 21.

Such a configuration is designed to function so that by applying pressure to the cushioning means 10, 11, 12 and based on the resulting increased mechanical tension, the cushioning fluid is forced out of the cushioning element 10, 11, 12, and the displaced cushioning fluid is distributed among the remaining length of the respective cushioning element and flows through the tube sections 16 due to the elastic deformation of the cushion or tube 15. Depending on the voltage applied at the electrodes 17 and the thereby created change in the viscosity of the cushioning fluid, the respective tube sections 16 then function as regulators, so that the properties of the sole can be controlled dynamically based on the signal of the sensor 19.

As depicted in FIG. 1, there are preferably several sensors 6, 7, 8 distributed over the surface of the sole, so that when pressure is applied to the shoe sole by the sole of the foot, the cushioning is increased due to an increase in the viscosity of the cushioning fluid or conversely the cushioning is reduced by a reduction of the viscosity of the cushioning fluid.

As described above, the sensors 6, 7, 8 are sensors that function according to the piezo effect and provide an electric signal based on the deformation of the sensor.

Generally it is possible to control the pairs of electrodes 17, 17 located on the tube sections 16 singly or in groups by means of the electronic control circuitry 18, from signals of one or more sensors, e.g. also using specified control patterns defined in the electronic control circuitry 18 or in memory located there.

Furthermore, it is possible to replace or supplement a sensor 6, 7, 8 with an adjusting device that can be used to manually adjust the degree of cushioning or stiffness of the cushioning elements 10, 11, 12.

The electronic circuitry 18, the power supply, if needed, in the form of a battery, e.g. a rechargeable battery, the adjusting device 20 and possibly a display 21 that provides information on the current status of the system are to be accommodated in the shoe sole or at a suitable location on the shoe.

In the above description, the effect on the viscosity of the cushioning fluid was indicated by means of an electric field. Generally it is also possible to use a magnetic field instead of an electric field for the cushioning fluid. In this case, magnet coils that are controlled by the electronic control circuitry 18 are required instead of the electrodes 17.

In a further embodiment of the invention, chambers or closed areas can be provided in the shoe sole with the variable-viscosity fluid, so that pressure exerted by the foot on the shoe sole causes this fluid to flow. By changing the viscosity of the fluid, the flow can be regulated to increase or decrease, which enables control of the deformability of the sole.

What is claimed is:

1. A shoe, with a sole that cushions mechanical stress while running, comprising a first outer area providing damping or cushioning of the shoe as a first dampening or cushioning area area, a second middle sensor area, in which force is transferred to electric sensors distributed over the sole, and a third inner area with active cushioning devices, to which voltage produced in the second area is transferred and the dampening or cushioning properties of the active cushioning devices are controlled depending on said voltage wherein the active cushioning devices are inserts with electro-rheological fluids, which alter cushioning behavior of the third area.

2. The shoe as claimed in claim 1, wherein the sensors are distributed in sections within the second area.

3. The shoe as claimed in claim 1, wherein the inserts placed at locations in which the maximum pressure load values and/or the maximum stress integral occur during a step of the foot.

4. The shoe as claimed in claim 1, further comprising an acceleration meter located in the shoe that measures a speed of a runner and sends this value to an electronic control circuitry as an additional information signal.

5. A shoe with a sole that cushions mechanical stress while running, comprising a first outer area providing damping or cushioning of the shoe as a damping or cushioning area, a second middle sensor area, in which force is transferred to sensors distributed over the sole, and a third inner area with active cushioning devices, to which the voltage produced in the second area is transferred and the damping or cushioning properties of the active cushioning device are controlled depending on said voltage, wherein the active cushioning devices are inserts with electro-rheological fluids, which alter cushioning behavior of the third area.

6. The shoe as claimed in claim 5, wherein the sensors are electric sensors.

7. The shoe as claimed in claim 6, wherein the sensors are made from piezo ceramics or piezo-electric PVDF (polyvinylfluoride).

8. The shoe as claimed in claim 5, wherein the electric sensors are placed at locations in which the maximum pressure load values and/or the maximum stress integral occur during a step of the foot.

9. The shoe as claimed in claim 5, wherein the base material of the electro-rheological fluids is oil with finely dispersed particles that determines the base viscosity.

10. The shoe as claimed in claim 5, wherein by applying an electric field to the piezo-electric base material a viscosity of the base material can be altered, which causes a piezo-electric device to function as the sensor, which creates electric voltage based on the pressure on the shoe sole.

11. The shoe as claimed in claim 5, wherein the voltage is processed by electronic control circuitry or is sent directly to the electro-rheological fluid.

12. The shoe as claimed in claim 5, wherein an acceleration meter located in the shoe measures speed of a runner and sends the value to an electronic control circuitry as an additional information signal.

13. A shoe with a sole that cushions mechanical stress while running, comprising a first outer area providing damping or cushioning of the shoe as a damping or cushioning area, a second middle sensor area, in which the force is transferred to sensors distributed over the sole, the sensors comprising a piezo-electric base material, and a third inner area with active cushioning devices, to which the voltage produced in the second area is transferred and the damping or cushioning properties of which are controlled depending on said voltage, wherein by applying an electric field to the piezo-electric base material, a viscosity of the base material can be altered, which causes a piezo-electric device to function as the sensor, which creates the electric voltage based on the pressure on the shoe sole.

14. A shoe with a sole that cushions mechanical stress while running, comprising a first outer area providing damping or cushioning of the shoe as a damping or cushioning area, a second middle sensor area, in which the force is transferred to sensors distributed over the sole, and a third inner area with active cushioning devices, to which the voltage produced in the second area is transferred and the damping or cushioning properties of which are controlled depending on said voltage, wherein the sensors are made from piezo-electric PVDF (polyvinylfluoride) material and wherein by applying an electric field to the sensor material, a viscosity of the material can be altered, which causes a piezo-electric voltage device to function as the sensor, which creates the electric voltage based on the pressure on the shoe sole.

15. The shoe as claimed in claim 14, wherein the active cushioning devices are inserts with electro-rheological fluids, which alter cushioning behavior of the third area.

16. The shoe as claimed in claim 14, wherein in the third area, the sensors are placed at locations in which the maximum pressure load values and/or the maximum stress integral occur during a step of the foot.

17. The shoe as claimed in claim 14, wherein the active cushioning devices comprise electro-rheological fluids, the base material of the electro-rheological fluids is oil with finely dispersed particles that determines the base viscosity.

18. The shoe as claimed in claim 14, wherein the voltage is processed by electronic control circuitry or is sent directly to the electro-rheological fluid.

19. The shoe as claimed claim 14, wherein an acceleration meter located in the shoe measures a speed of a runner and sends this value to an electronic control circuitry as an additional information signal.

* * * * *